United States Patent [19]

Saul et al.

[11] Patent Number: 4,477,798

[45] Date of Patent: Oct. 16, 1984

[54] FIRE ALARM CONTROL SYSTEM

[75] Inventors: Ben Saul, Montreal; Doug Hartley, Dollard des Ormeaux, both of Canada

[73] Assignee: Sur-Gard Security Systems Ltd., Mount Royal, Canada

[21] Appl. No.: 372,069

[22] Filed: Apr. 26, 1982

[51] Int. Cl.[3] ..... G08B 23/00

[52] U.S. Cl. ..... 340/527; 340/506; 340/528; 340/309.15

[58] Field of Search ..... 340/527, 528, 529, 506, 340/309.15

[56] References Cited

U.S. PATENT DOCUMENTS

| | | | |
|---|---|---|---|
| 3,760,397 | 9/1973 | Taggart | 340/527 |
| 4,114,147 | 9/1978 | Hile | 340/528 |
| 4,189,719 | 2/1980 | Massa et al. | 340/528 |

*Primary Examiner*—Donnie L. Crosland

[57] ABSTRACT

A fire alarm control system in which an electronic switch circuit is responsive to an increase input current signal generated by one or more fire detection devices. A local alarm is connected to the electronic switch circuit to indicate an alarm state. A delay timer circuit is connected to the electronic switch circuit and operated thereby to activate a remote alarm after a predetermined time delay. A manual two-position switch is movable to a silence position from its normal position within the time delay to disable the local and remote alarms and movable back to its normal position to cut off power to the detection devices and electronic switch means to unlatch the alarms. A further pair of manually operable switches are provided to instantaneously reactivate the disabled local and remote alarms when the two-position switch is in the normal position.

10 Claims, 1 Drawing Figure

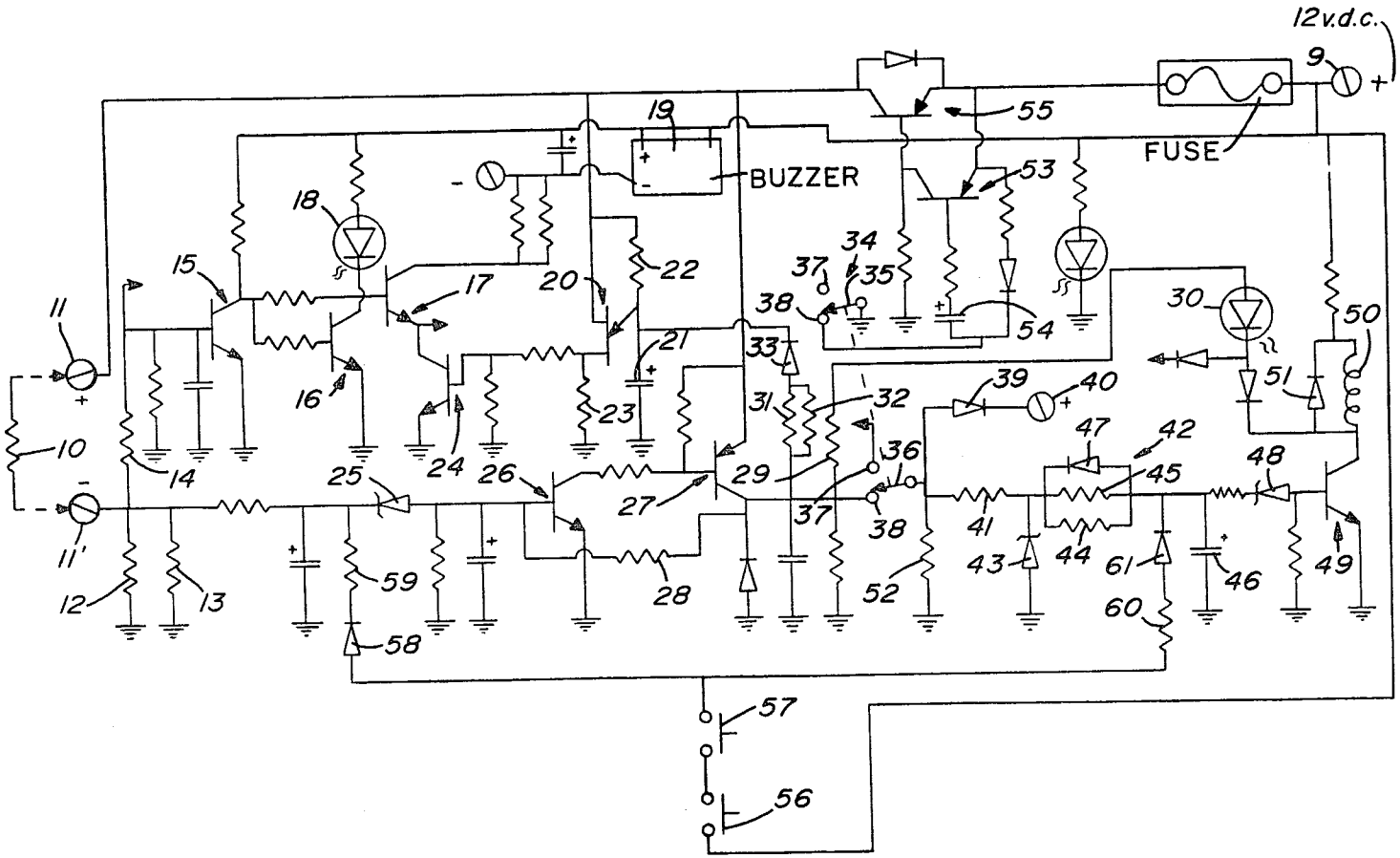
12v.d.c.
FUSE
BUZZER

FIRE ALARM CONTROL SYSTEM

BACKGROUND OF INVENTION (a) Field of Invention

The present invention relates to a fire alarm control system embodying a single switch capable of silencing local alarms and preventing the transmission of a remote alarm and further being capable of resetting the system.

(b) Description of Prior Art

To date, commercial and residential fire alarm control systems use separate control switches for the "reset", "alarm silence" and "remote station disconnect" functions. Fire alarm control systems have latching circuitry to lock in an alarm signal for the needed time whether the detection device itself stays latched in or just gives a momentary signal as in the case of some heat detectors. Systems using smoke detectors stay latched in alarm electronically with a visual indication after detecting smoke. This makes it possible to determine which unit triggered the alarm in cases of false alarm or little smoke where the cause is not obvious. Most fire alarm systems sound audible signals such as bells or horns since warning occupants of the fire danger is usually the system's main purpose. These audible signals need to be silenced once the warning has been given. The control system circuitry and the smoke detector need to be reset, ready to work again, but only after the source of the alarm has been identified. Hence, known systems provide at least two switches, one to silence and one to reset the system. The silence is generally a two-position switch and the reset is usually a momentary switch of the push-button or spring return type. In addition, systems connected to the fire department or a remote central monitoring station require a third switch to disconnect this alarm output to the remote station for testing, fire drills or repairs.

With this type of switching as utilized in the prior art, if the operator gets confused, he may reset the system while attempting to silence the alarm and lose the information giving the origin of the alarm.

SUMMARY OF INVENTION

It is a feature of the present invention to thereby provide a fire alarm control system which substantially obviates all of the above-mentioned disadvantages.

Another feature of the present invention is to provide a fire alarm control system which utilizes a single switch of only two positions to perform the reset (normal) and alarm silence functions. This greatly simplifies the operation of the system without losing any of the information or the degree of control available with separate switches as used in the prior art. This is specially important considering that a fire alarm control is used under the stress of emergency conditions by someone who probably would not have had practice at using it in this situation and he could get easily confused.

Another feature of the present invention is to provide a fire alarm control system wherein a remote alarm is triggered after a predetermined time delay which is also disconnectible by the single two-position switch and wherein the switch in the alarm silence position maintains the system latched in alarm as well as smoke detectors connected to its input and wherein the switch is placeable back to its normal position to place the system back in its normal operation.

According to the above features, from a broad aspect, the present invention provides a fire alarm control system comprising electronic switch means responsive to an increase input current signal generated by one or more alarm detection devices. Local alarm means are connected to the electronic switch means to indicate an alarm state. A delay timer circuit is connected to the electronic switch means and operated thereby to activate a remote alarm means after a predetermined time delay. A manual two-position switch movable to a silence position from its normal position within the time delay to disable the local and remote alarm means and movable back to its normal position to cut off power to the detection devices and the electronic switch means to unlatch the alarm means. A further manually operable switch means is provided to instantaneously reactivate the disabled local and remote alarm means when the two-position switch is in the normal position.

BRIEF DESCRIPTION OF DRAWINGS

A preferred embodiment of the present invention will now be described with reference to the accompanying drawing which is a schematic diagram of the fire alarm control system of the present invention.

Referring now to the drawing, there is illustrated the fire alarm control system of the present invention. As herein shown an input load 10 is connected to input terminals 11, 11' of the system. The load 10 consists of an end of line supervision resistor and also may include a plurality of smoke detectors which detectors draw a small percentage of the total normal supervisory condition load current. Input resistors 12 and 13 are connected in parallel to the negative terminal 11' and provide a current sensing and current limiting circuit for normal supervisory and alarm conditions of the system. In the supervisory state, the end of line resistor and smoke detector stand-by current present at the terminal 11' of the load 10 passes about 15 milliamperes through the combination of resistances R12 and R13 producing slightly over 1 volt across resistance 14. This maintains transistor 15 in a conducting state and transistors 16 and 17 in non-conducting state.

For an open circuit condition to be present across the input terminals such as when a wire becomes disconnected or is cut, the detection circuit would remove the base voltage applied to transistor 15, turning off this transistor and turning on transistors 16 and 17. The operation of transistors 16 and 17 would cause a yellow LED lamp 18 to light and a buzzer 19 to be activated in a pulsing state, approximately once every 30 seconds. The buzzer 19 pulses because of the uni-junction circuit consisting of transistor 20, capacitor 21, resistor 22, and resistor 23 which switches the emitter of transistor 17 via transistor 24.

When the detection circuit current increases past about 60 milliamps., necessary to indicate a fire alarm condition, the voltage drop across resistors 12 and 13 overcomes the zener threshold of zener diode 25. This turns on transistors 26 and 27. Resistance 28 latches the alarm. The alarm output transistor 27 supplies positive DC voltage through resistance 29 to a red LED lamp 30 and to the combination of resistances 31 and 32 and diode 33 which speeds up the pulsor circuit previously described to about 1 pulse every second. Consequently, the red LED lamp 30 pulses to indicate the alarm state before tripping a central station remote alarm.

The system of the present invention also provides a manual two-position switch 34 capable of disabling the local and remote alarms and unlatching them. The two-position switch 34 has a double contact arm, arms 35 and 36, displaceable to a silence position 37 and a normal position (reset) 38. So long as the switch 34 is in the normal position 38 transistor 27 supplies the positive DC voltage through diode 39 to a siren device (not shown) connected to a siren output terminal 40. Transistor 27 also supplies a positive DC voltage to resistance 41 at the input of a central station delay timer circuit 42. The resistance 41 and a zener diode 43 regulate the DC voltage applied to the RC timing circuit 42. The timing circuit consists of resistance 44, resistance 45, and capacitor 46. Diode 47 serves to discharge the capacitor 46 when the alarm is reset or placed back in the normal position.

After a time delay of approximately 25 seconds (or 40 seconds with resistor 14 being removed) the voltage on capacitor 46 exceeds the zener threshold voltage of zener diode 48 sufficiently to turn on transistor 49 and activate the relay coil 50 which in turn closes relay contacts (not shown) to transmit an alarm signal to a remote alarm station by suitable means such as telephone lines, etc. When the relay coil 50 is activated the red LED lamp is turned on and maintained in a steady state through diode 51 and transistor 49.

When the switch 34 is placed to its silence position 37, the connection to the siren terminal 40 and remote station output is opened shutting off those functions. A resistor 52 connected to the input of the timer circuit 42 is now switched to the base of transistor 15 via the circuit between the contact 36 and the terminal 37 causing the yellow LED lamp 18 to light and the buzzer 19 to pulse at the faster (once every 3 seconds) rate as a reminder of the condition of the system.

When switch 34 is placed back to the normal (reset) position 38, transistor 53 is momentarily turned on through capacitor 54, shorting the base current of transistor 55 thus switching off transistor 55. With transistor 55 shut off, the power at terminal 9 is cut off from the smoke detector (load 10) as well as the alarm output transistor 27, thereby unlatching the alarm state.

The alarm signal is then generated manually without the normal delay by pushing the two momentary switches 56 and 57 together. This applies a signal through diode 58 and resistor 59 to transistor 26 to trip the alarm and through resistance 60 and diode 61 to accelerate the remote station alarm delay to practically nothing. It is pointed out that the switch 34 would be in the normal position 38 to have the local alarm sound and for the remote station alarm output relay to stay latched in alarm.

In summary, in an alarm condition, the system activates a visual and audible local alarm. The timer circuit is also activated and charges over a predetermined time period. By placing the switch 34 to the silence position, within the predetermined time delay, the local alarms are disabled giving the operator time to verify the nature of the alarm. If the alarm is real, the operator then switches the system back to the normal (reset) position and depresses switches 56 and 57 simultaneously immediately triggering all local and remote alarms.

It is within the ambit of the present invention to cover any obvious modifications of the preferred embodiment described herein, provided such modifications fall within the scope of the appended claims.

We claim:

1. A fire alarm control system comprising electronic switch means responsive to an increase input current signal generated by one or more alarm detection devices, local alarm means connected to said electronic switch means to indicate an alarm state, a delay timer circuit connected to said electronic switch means and operated thereby to activate a remote alarm means after a predetermined time delay, a manual two-position switch movable to a silence position from its normal position within said time delay to disable said local and remote alarm means and movable back to its normal position to cut off power to said detection devices and electronic switch means to unlatch both said local and remote alarm means, and further manually operable switch means to instantaneously reactivate said disabled local and remote alarm means when said two-position switch is in said normal position.

2. A system as claimed in claim 1 wherein there is further provided an open line supervisory circuit for detecting an open circuit condition in a load connected to input terminals of said system.

3. A system as claimed in claim 1 wherein said two-position switch is a double-arm double-contact single throw switch, one arm of said double-arm interconnecting said electronic switch means to said timer circuit when in said normal position and activating a pulsating local reminder alarm when in said silence position, the other arm of said double-arm when placed back to its normal position causing a cut off circuit to operate to cut off power to said detection device.

4. A system as claimed in claim 3 wherein said electronic switch means comprises a transistor circuit to supply a pulsating DC voltage to said local alarm means which is constituted by a visual and audible alarm device, said transistor circuit also supplying a steady voltage to a local siren device.

5. A system as claimed in claim 4 wherein said transistor circuit also supplies a steady DC voltage to said delay timer circuit which is connected to a relay coil via a zener diode and a switching transistor to activate relay contacts to switch said remote alarm means.

6. A system as claimed in claim 5 wherein said visual local alarm device is placed in a steady state from its pulsating state through a diode when said switching transistor is operated to indicate that said remote alarm means is activated.

7. A system as claimed in claim 5 wherein said delay timer circuit is an RC timing network consisting of a parallel connection of a diode and two resistors having a common output connected to a charging capacitor, said diode discharging said capacitor when said switch is placed back to its normal position prior to the expiration of said predetermined time delay.

8. A system as claimed in claim 1 wherein said further manually operable switch means comprises a pair of push-button switches connected in series whereby to connect said input current signal directly to said local and remote alarms to activate same.

9. A system as claimed in claim 2 wherein said supervisory circuit comprises an input voltage divider circuit to provide a biasing voltage to an input transistor of a detection transistor circuit, said input transistor when in a nonconducting state causing switching transistors to activate a further local alarm.

10. A system as claimed in claim 9 wherein said further local alarm is a pulsating alarm consisting of a visual and audible alarm differentiatable from said local alarm means.

* * * * *